US010720298B2

(12) United States Patent
Mazellier et al.

(10) Patent No.: US 10,720,298 B2
(45) Date of Patent: Jul. 21, 2020

(54) VACUUM ELECTRON TUBE WITH PLANAR CATHODE BASED ON NANOTUBES OR NANOWIRES

(71) Applicant: THALES, Courbevoie (FR)

(72) Inventors: Jean-Paul Mazellier, Palaiseau (FR); Lucie Sabaut, Palaiseau (FR)

(73) Assignee: THALES, Courbevoie (FR)

( * ) Notice: Subject to any disclaimer, the term of this patent is extended or adjusted under 35 U.S.C. 154(b) by 282 days.

(21) Appl. No.: 15/638,237

(22) Filed: Jun. 29, 2017

(65) Prior Publication Data

US 2018/0012723 A1 Jan. 11, 2018

(30) Foreign Application Priority Data

Jul. 7, 2016 (FR) ..... 16 01057

(51) Int. Cl.

| | |
|---|---|
| ***H01J 1/15*** | (2006.01) |
| ***H01J 35/06*** | (2006.01) |
| ***H01J 1/312*** | (2006.01) |
| ***H01J 21/10*** | (2006.01) |
| ***H01J 23/04*** | (2006.01) |

(52) U.S. Cl.

CPC ..... *H01J 35/065* (2013.01); *H01J 1/15* (2013.01); *H01J 1/312* (2013.01); *H01J 21/105* (2013.01); *H01J 23/04* (2013.01); *H01J 2201/30423* (2013.01); *H01J 2201/30434* (2013.01); *H01J 2235/068* (2013.01)

(58) Field of Classification Search

CPC ..... A61B 6/40; A61B 6/4007; A61B 6/4014; H01J 17/06; H01J 17/02; H01J 17/48; H01J 19/00; H01J 19/02

See application file for complete search history.

(56) References Cited

U.S. PATENT DOCUMENTS

| | | | | |
|---|---|---|---|---|
| 2004/0116034 | A1 | 6/2004 | Den et al. | |
| 2007/0212538 | A1* | 9/2007 | Niu | H01B 1/04 428/367 |
| 2010/0045212 | A1 | 2/2010 | Mancevski | |
| 2010/0181896 | A1 | 7/2010 | Lee et al. | |
| 2013/0229105 | A1* | 9/2013 | Cheatham, III | H01J 29/02 313/153 |

FOREIGN PATENT DOCUMENTS

| | | | |
|---|---|---|---|
| JP | 2000-311578 | A | 11/2000 |
| WO | 2016/102575 | A1 | 6/2016 |

* cited by examiner

*Primary Examiner* — David P Porta
*Assistant Examiner* — Mamadou Faye
(74) *Attorney, Agent, or Firm* — Baker & Hostetler LLP

(57) ABSTRACT

A vacuum electron tube comprises at least one electron-emitting cathode and at least one anode arranged in a vacuum chamber, the cathode having a planar structure comprising a substrate comprising a conductive material, a plurality of nanotube or nanowire elements electrically insulated from the substrate, the longitudinal axis of the nanotube or nanowire elements substantially parallel to the plane of the substrate, and at least one first connector electrically linked to at least one nanotube or nanowire element so as to be able to apply a first electrical potential to the nanowire or nanotube element.

17 Claims, 17 Drawing Sheets

VACUUM ELECTRON TUBE WITH PLANAR CATHODE BASED ON NANOTUBES OR NANOWIRES

CROSS-REFERENCE TO RELATED APPLICATIONS

This application claims priority to foreign French patent application No. FR 1601057, filed on Jul. 7, 2016, the disclosure of which is incorporated by reference in its entirety.

FIELD OF THE INVENTIONb

The invention relates to the field of vacuum electron tubes, applications of which include for example the production of X-ray tubes or of travelling wave tubes (TWTs). More particularly, the invention relates to the vacuum electron tubes whose cathode is based on nanotube or nanowire elements.

BACKGROUND

The structure of a vacuum electron tube is known, as illustrated by FIG. 1. An electron-emitting cathode Cath and an anode A are arranged in a vacuum chamber E. A potential difference V0, typically between 10 KV and 500 KV, is applied between the anode A and the cathode Cath to generate an electrical field E0 inside the chamber, allowing the extraction of the electrons from the cathode and the acceleration thereof, to produce an "electron gun". The electrons are attracted to the anode under the influence of the electrical field E0. The electrical field generated by the anode has 3 functions:

extractions of the electrons from the cathode (for the cold cathodes), to give a trajectory to the electrons for them to be used in the tube. For example, in a TWT, that makes it possible to inject the electron beam into the interaction impeller, to give energy to the electrons through the voltage gradient for the needs of the tube. For example, in an X-ray tube, the energy of the electrons controls the X-ray emission spectrum.

A TWT is a tube in which an electron beam transits in a metal impeller. An RF wave is guided in this impeller in order to interact with the electron beam. This interaction results in a transfer of energy between the electron beam and the RF wave which is amplified. A TWT is therefore a high-power amplifier, that is found for example in telecommunications satellites.

In an X-ray tube, according to one embodiment, the electrons are braked by impact on the anode, and these decelerated electrons emit an electromagnetic wave. If the initial energy of the electrons is strong enough (at least 1 keV), the associated radiation is in the X range. According to another embodiment, the energetic electrons interact with the core electrons of the atoms of the target (anode). The electron reorganization induced is accompanied by the emission of a photon of characteristic energy.

Thus, the electrons emitted by the cathode are accelerated by the external field E0 either towards a target/anode (typically made of tungsten) for an X-ray tube, or to an interaction impeller for a TWT.

In order to produce a (quasi-)continuous emission of electrons, two technologies are employed: (i) cold cathodes and (ii) thermoionic cathodes.

Cold cathodes are based on an electron emission by field emission: an intense electrical field (a few V/nm) applied to a material allows a curvature of the energy barrier that is sufficient to allow the electrons to transit to the vacuum by tunnel effect. Obtaining such intense fields macroscopically is impossible.

Cathodes with vertical tips use the field emission combined with the tip effect. For this, a geometry that is very widely used and developed in the literature consists in producing vertical tips P (with a strong aspect ratio) on a substrate as illustrated by FIG. 2. By tip effect, the field at the tip of the emitter can be of the order sought. This field is generated by the electrostatic disturbance represented by the tip in a uniform field. In this configuration, a uniform external field E0 is applied. It is the variation of this field which makes it possible to control the field level at the tip of the emitters and therefore the corresponding emitted current level.

The first gated cathodes, called Spindt tips, were developed in the 1970s and are illustrated in FIG. 3. Their principle is based on the use of a conductive tip 20 surrounded by a control gate 25. Typically, the apex is on the plane of the gate. It is the potential difference between the tips and the gate which makes it possible to modulate the electrical field level at the apex of the tips (and therefore the current emitted). These structures are known for their very high sensitivity to the tip/gate alignment and for the problems of electrical insulation between the 2 elements.

More recently, tip emitters have been produced from carbon nanotubes or CNTs, arranged vertically, at right angles to the substrate.

A gated cathode with carbon nanotubes CNT is also described for example in the patent application No PCT/EP2015/080990 and illustrated in FIG. 4. A gate G is arranged around each VACNT (for "Vertically Aligned CNT").

The field emission results from the electrical field on the surface of a typically metallic material. Now, this field is directly linked to the gradient of the electrical potential field applied.

In a conventional cathode (no gate), the potential field results from the combination of the influences of the external field and from the potential of the nanotube alone. Now, these two are linked.

In a cathode of "gated" type, the potential field at the level of the nanotubes results from the combination of the influences of the external electrical field, from the potential of the nanotube (as previously) but also from the potential induced by the gate which is independent of the other two. Thus, it is possible to modify the electron emission level by acting with this new electrode introduced into the system.

Generally, the field amplification factor associated with each emitter is strongly linked to its height and to the radius of curvature of its tip. Dispersions in these two parameters induce amplification factor dispersions. Now, the tunnel effect is an exponential law involving this amplification factor: thus, by considering a cohort of emitters, only a fraction (which can be relatively low, of the order of one percent or less) really participates in the electron emission. For a target total current, this requires the actual emitters to be able to emit relatively high currents (compared to an emission which would be uniform and distributed uniformly over all the emitters).

The production of these emitters in tip form is done:

either directly on the substrate, by etching (e.g.: silicon tips), by direct growth (example: CNT). These two methods have to allow a preferential orientation of the tips at right angles to the substrate;

or by mounting: synthesis of a nanomaterial (in nanotube/nanowire form) then mounting on a substrate. A step of orientation at right angles to the substrate is also necessary.

With a production directly on substrate, significant radius/height dispersions are known in the literature. In addition, in the specific case of the CNTs grown on substrate, the orientation at right angles to the substrate is controlled but the quality of the material is notably lower than that of the CNT material obtained by CVD growth. One means of reducing the height dispersion is to perform a polishing on encapsulated material: the drawback lies in the fact that the polished material is defective, which reduces the associated emission performance levels.

In the case of materials grown then mounted on substrate, obtaining an orientation at right angles to the substrate is complex (not localized, actual height uncontrolled, etc.).

Cathodes that have a planar geometry (no object orientation at right angles to the substrate) based on nanowire, known from the literature, are still based on the tip effect. However, in order to mitigate the orientation not at right angles to the substrate, a counter-electrode to the electrode bearing the emitter is incorporated in the substrate. A first example is illustrated in FIG. 5: an emitter of Pp tip type, of ZnO nanowire type, is parallel to the substrate. One of its ends is connected to an electrode (cathode Cath) and a counter-electrode (anode A) makes it possible to generate the equivalent of the homogeneous field E0 in the case of the vertical structures. The emission still appears at the apex of the tip. The electron beam is propagated from the emitter to the anode, it is possible but difficult to deflect the beam to use it elsewhere (notably to inject it into a conventional electron tube). Another example operating according to the same principle, comprising a gate G and a tip Pp of doped polysilicon, is illustrated in FIG. 6.

In the case of a vacuum tube, the aim is to use the electron beam "far" from the cathode. In the case of a planar structure, the anode is in direct proximity to the emissive element (in order to limit the voltages to be applied) which means that the beam travels a very short distance before being intercepted by the anode. It cannot therefore be used further away in the vacuum tube.

The thermoionic cathodes use the thermoionic effect to emit electrons. This effect consists in emitting electrons through heating. For that, the two electrodes arranged at the ends of a filament are biased. The application of a potential difference between the two ends generates a current in the filament, which heats up through Joule's effect. When it reaches a certain temperature (typically 1000 degrees Celsius) electrons are emitted. In effect, simply the fact of heating allows some electrons to have a thermal energy greater than the metal-vacuum barrier: thus, they are spontaneously extracted to the vacuum.

There are cathodes in pad form (of the order of one millimetre) with an electric filament placed underneath to ensure the heating of the material, which will then emit electrons.

The thermoionic cathodes make it possible to supply high currents over long periods in relatively medium vacuums (up to $10^{-6}$ mbar for example). However, their emission is difficult to switch rapidly (on the scale of a fraction of a GHz for example), the size of the source is fixed and their temperature limits the compactness of the tubes in which they are incorporated.

One aim of the present invention is to mitigate the drawbacks mentioned above by proposing a vacuum electron tube having a planar cathode based on nanotubes or nanowires that makes it possible to overcome a certain number of limitations linked to the use of vertical emitting tips, while using the tunnel effect or the thermoionic effect or a combination of the two.

SUMMARY OF THE INVENTION

The subject of the present invention is a vacuum electron tube comprising at least one electron-emitting cathode and at least one anode arranged in a vacuum chamber, the cathode having a planar structure comprising a substrate comprising a conductive material, a plurality of nanotube or nanowire elements electrically insulated from the substrate, the longitudinal axis of said nanotube or nanowire elements being substantially parallel to the plane of the substrate, and at least one first connector electrically linked to at least one nanotube or nanowire element so as to be able to apply a first electrical potential to the nanowire or nanotube element.

Preferentially, the nanotube or nanowire elements are substantially parallel to one another.

According to a preferred embodiment, the first connector comprises a substantially planar contact element arranged on an insulating layer and linked to a first end of the nanotube or nanowire element.

Advantageously, the cathode further comprises a first control means linked to the first connector and to the substrate, and configured to apply a bias voltage between the substrate and the nanotube element so that the nanotube or nanowire element emits electrons through its surface by tunnel effect. Advantageously, the bias voltage lies between 100 V and 1000 V.

Advantageously, the nanotube or nanowire elements have a radius of between 1 nm and 100 nm.

According to a variant, the cathode comprises a second electrical connector linked electrically to at least one nanotube or nanowire element so as to be able to apply a second electrical potential to the nanotube or nanowire element.

According to a preferred embodiment of the variant, the first and the second connectors respectively comprise a first and a second substantially planar contact elements arranged on an insulating layer and respectively linked to a first and a second ends of said nanotube or nanowire element.

Preferentially, the cathode comprises at least one nanotube or nanowire element linked simultaneously to the first connector and to the second connector.

According to a variant, the cathode further comprises means for heating the nanotube or nanowire element.

According to an embodiment of this variant, the cathode comprises a second control means linked to the first and to the second connectors and configured to apply a heating voltage to said nanotube or nanowire element via the first and the second electrical potentials, so as to generate an electric current in said nanotube or nanowire element, such that the nanotube or nanowire element emits electrons through its surface by thermoionic effect. Preferentially, the heating voltage lies between 0.1 V and 10 V.

According to an embodiment, the nanotube or nanowire elements are partially buried in a burying insulating layer.

According to an embodiment, the cathode is divided into a plurality of zones, the nanotube or nanowire elements of each zone being linked to a different first electrical connector, such that the bias voltages applied to each zone are independent and reconfigurable.

According to a variant, the nanotube or nanowire elements are conductors.

According to another variant, the nanotube or nanowire elements are semiconductors and in which the bias voltage is greater than a threshold voltage, the nanowire or nanotube element then constituting a channel of a capacitor of MOS type, so as to generate free carriers in the nanowire or nanotube element.

Preferentially, the cathode further comprises a light source configured to illuminate the nanotube or nanowire element so as to generate free carriers in said nanowire or nanotube element by photogeneration.

BRIEF DESCRIPTION OF THE DRAWINGS

Other features, aims and advantages of the present invention will become apparent on reading the following detailed description and in light of the attached drawings given as nonlimiting examples and in which:

FIG. 22*a* schematically represents a first step and FIG. 22*b* a second step.

FIG. 23*a* schematically represents a first step and FIG. 23*b* a second step.

DETAILED DESCRIPTION

A vacuum tube is proposed here based on nanotube or nanowire elements arranged according to a planar geometry, whereas all of the prior art has always sought to use the tip effect associated with the form of the nanotube/nanowire cathodes to produce vacuum-tube cathodes.

Figure 1:
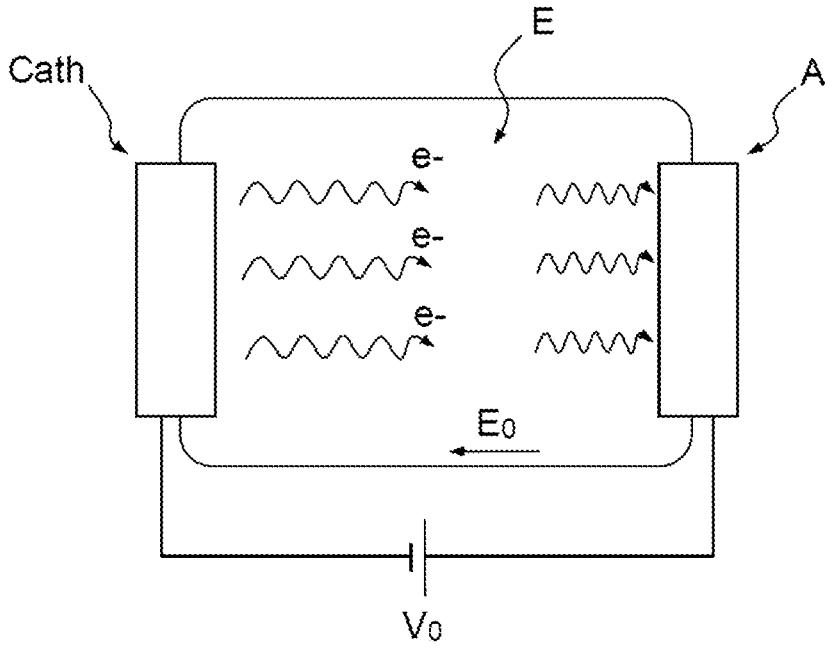
FIG. 1, already cited, schematically represents a vacuum electron tube known from the prior art.
Figure 2:
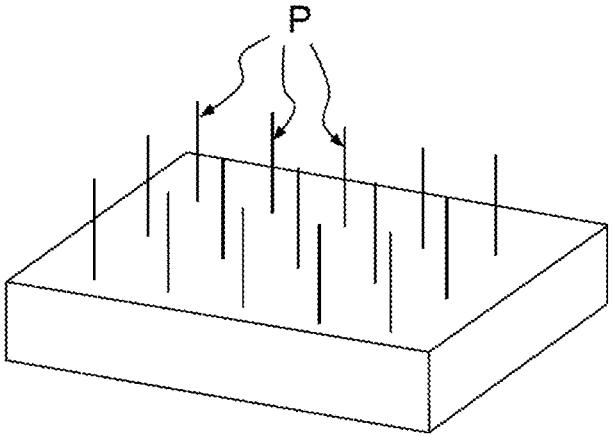
FIG. 2, already cited, illustrates a vertical-tip cathode.
Figure 3:
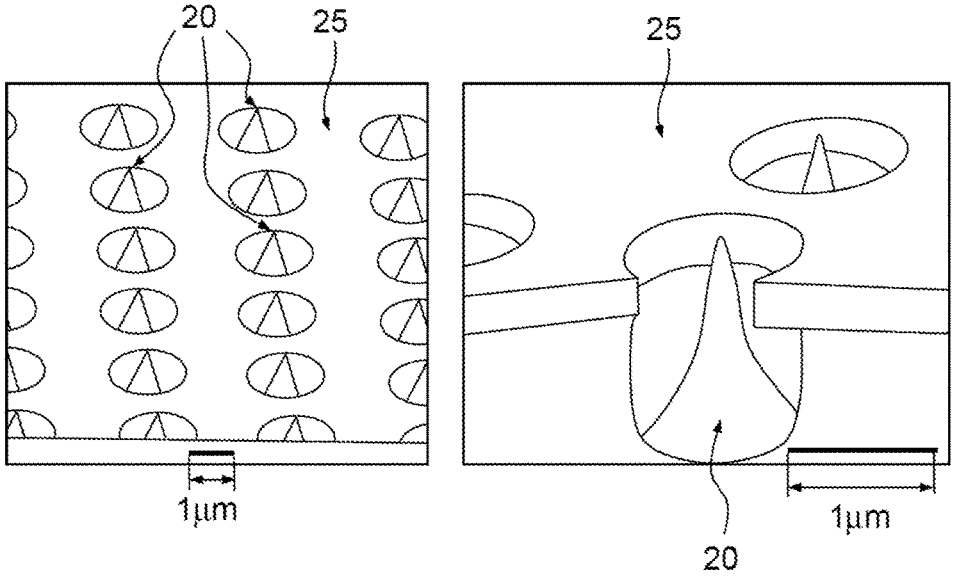
FIG. 3, already cited, shows an example of a "gated electrode" known from the prior art.
Figure 4:
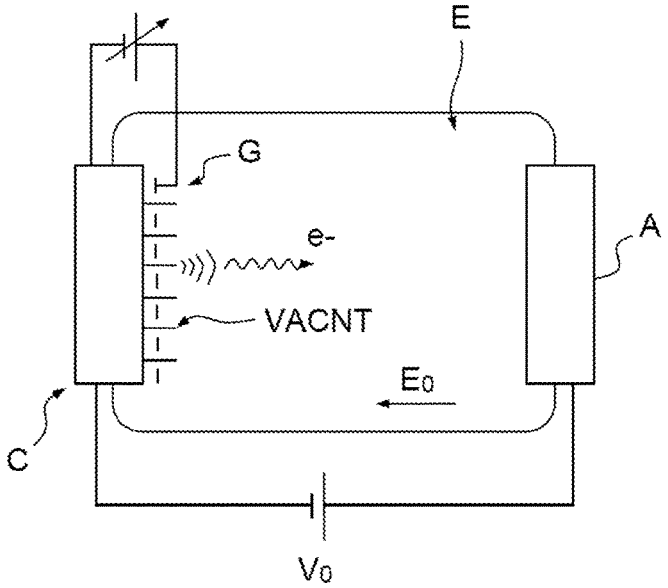
FIG. 4, already cited, schematically represents a vacuum electron tube of which the gated cathode is based on vertical carbon nanotubes known from the prior art.
Figure 5:
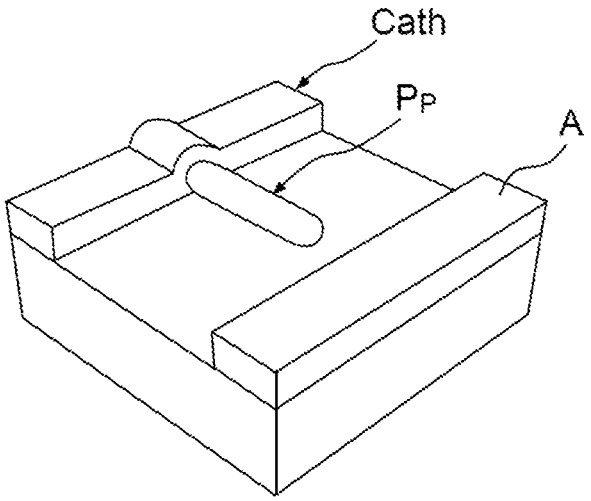
FIG. 5, already cited, illustrates a first example of a cathode with planar geometry of nanotube tip type known from the prior art.
Figure 6:
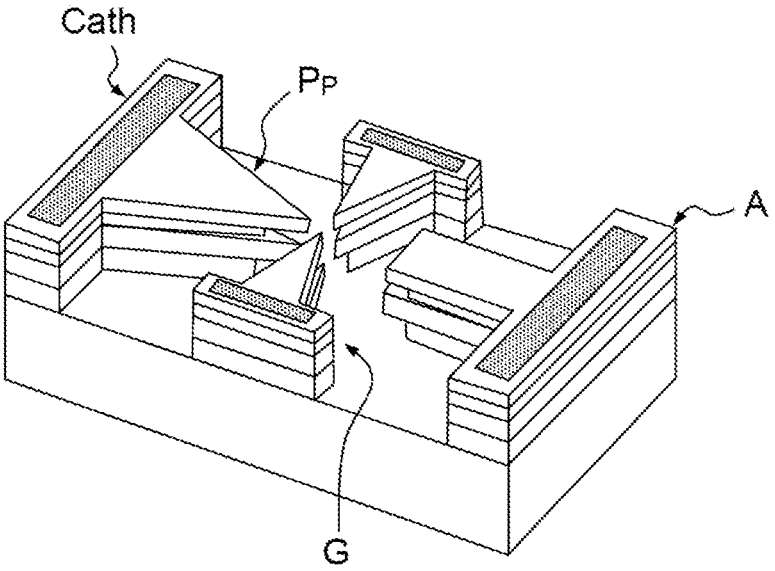
FIG. 6, already cited, illustrates a second example of a cathode with tip-based planar geometry known from the prior art.
Figure 7:
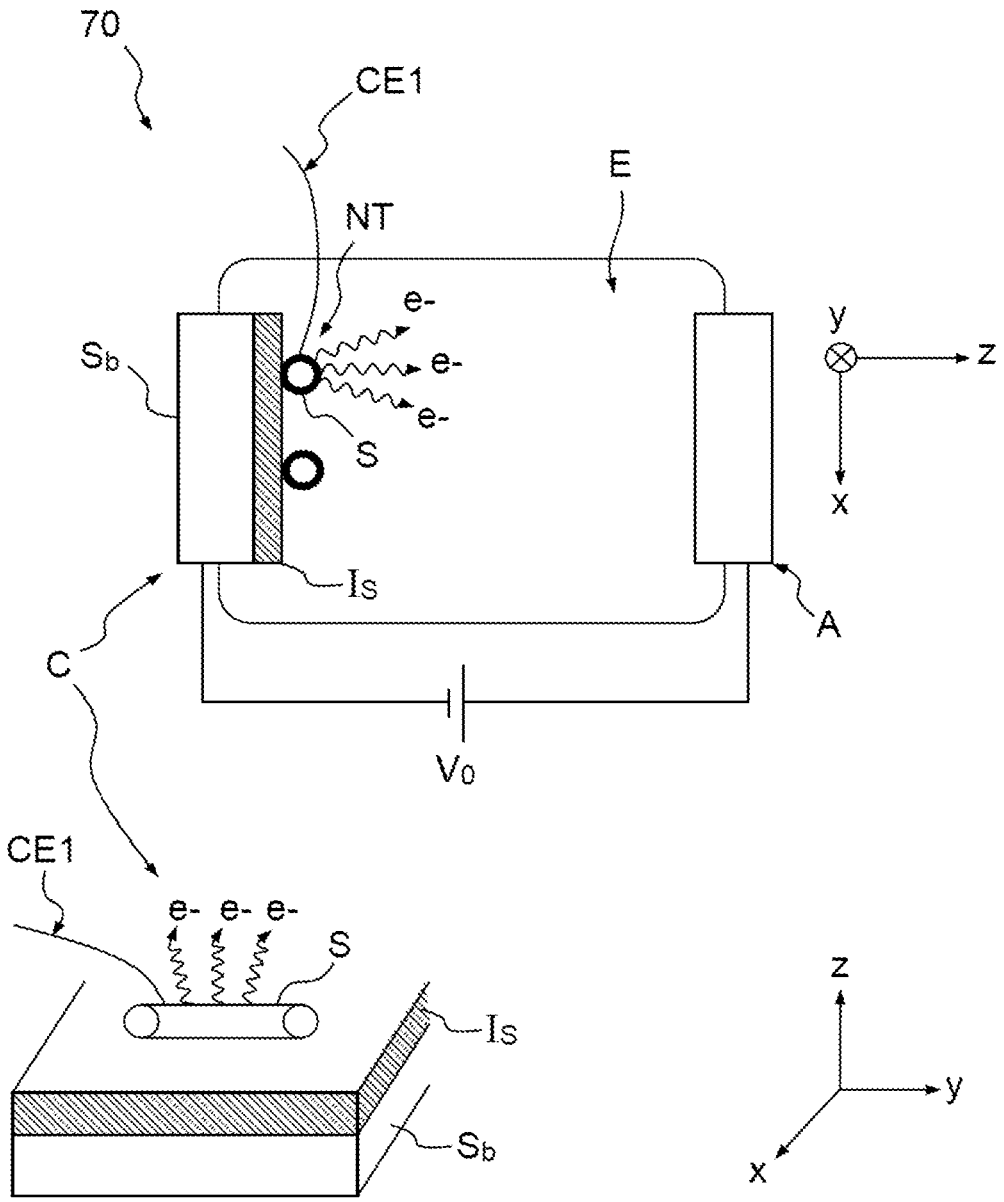
FIG. 7 illustrates a vacuum electron tube according to the invention.

The vacuum electron tube 70 according to the invention is illustrated in FIG. 7, which describes a profile view and a perspective view of the cathode C of the device. The vacuum electron tube according to the invention is typically an X-ray tube or a TWT.

The vacuum electron tube 70 comprises at least one electron-emitting cathode C and at least one anode A arranged in a vacuum chamber E. The specific feature of the invention lies in the original structure of the cathode, the rest of the tube being dimensioned according to the prior art.

The at least one cathode C of the tube 70 has a planar structure comprising a substrate Sb comprising a conductive material, that is to say a material exhibiting an electrical behaviour similar to a metal, and a plurality of nanotube or nanowire elements NT electrically insulated from the substrate.

According to an embodiment illustrated in FIG. 7, the insulation is made with an insulating layer Is deposited on the substrate, the nanotube or nanowire elements NT being arranged on the insulating layer Is. Planar structure should be understood to mean that the longitudinal axis of the nanotube or nanowire elements is substantially parallel to the plane of the insulating layer, as illustrated in FIG. 7.

Nanotubes and nanowires are known to those skilled in the art. Nanotubes and nanowires are elements whose diameter is less than 100 nanometers and whose length is from 1 to several tens of microns. The nanotube is a mostly hollow structure whereas the nanowire is a solid structure. The two types of nanoelement are globally called NT and are compatible with a cathode of the vacuum tube according to the invention.

Typically, the substrate is of doped silicon, doped silicon carbide, or any other conductive material compatible with the fabrication of the cathode.

The cathode further comprises at least one first connector CE1 linked electrically to at least one nanotube or nanowire element so as to be able to apply a first electrical potential to the element NT. The first connector CE1 thus allows electrical access to the elements NT. Because of the complexity of the fabrication technology, the elements NT of the cathode are not necessarily all connected. Hereinbelow, we will focus only on the elements NT actually linked electrically to the connector CE1.

Because of the planar structure, the (connected) elements NT of the cathode C in operation emit electrons from the surface S thereof. There are two variants each inducing a specific configuration of the cathode C according to the invention, according to the physical effect causing the emission of electrons. A first variant is based on the tunnel effect, a second variant is based on the thermoionic effect, the two variants being able to be combined, allowing an increased emission of electrons. These two variants are described in detail later.

The planar structure of the elements NT offers numerous advantages. It makes it possible to produce the generic device illustrated in FIG. 7 which is compatible with the use of the two abovementioned effects, separately or together.

Furthermore, the fabrication of the elements NT according to the invention is performed from known technological building blocks, and does not require any growth of PECVD (plasma DC) type as in the case of the vertical carbon nanotubes, which releases the constraints on the materials that can be used and on the potential designs significantly. It is in particular possible to produce surface insulations (not currently compatible with PECVD growth) which makes it possible to obtain a higher level of robustness compared to the current "gated cathode" designs.

The elements NT can be produced by in-situ growth on a plate (catalyst localization methods for example) or by ex-situ growth methods with mounting. The two methods have advantages and drawbacks:

In-situ: no need for mounting, possible localization of the nanowires/nanotubes. But this method is more restricted and it is difficult to select the nanowires/nanotubes after the event.

Ex-situ: access to a much greater panel of growth methods than in-situ growth. This approach offers greater flexibility of implementation and of adaptation of the method to the material needs. Furthermore, it is possible to select nanomaterials of similar diameter to reduce the parameter for the field emission. Material quality control is also simplified. Finally, the commercial availability of a wide range of materials offers an advantageous design flexibility. This method does however present the drawback of requiring a step of mounting and of controlling the density to ensure the target spacing W between 2 nanowires/nanotubes.

The production of horizontal nanowires on substrate by etching is a theme widely studied for the requirements of microelectronics. The notions of size reduction and of size dispersion are in particular the focus of these studies. Several strategies have been successfully developed for addressing this issue (optical lithography DUV/EUV; electron beam lithography; "spacer lithography"; etc.). It should be noted that the production of these nanowires/nanotubes according to the invention is very similar to the gate production in the CMOS technologies which gates these days are achieving sizes of the order of 10 nm on the industrial scale.

Preferentially, for better operation, the nanotube or nanowire elements NT are substantially parallel to one another, and the average distance W between each element is controlled. An average distance between elements NT of the order of the thickness of the insulation is preferred. The parallel alignment ensures a greater integration compactness and therefore a greater number of active emitters per surface area unit, which potentially increases the current emitted by the structure.

Figure 7B:
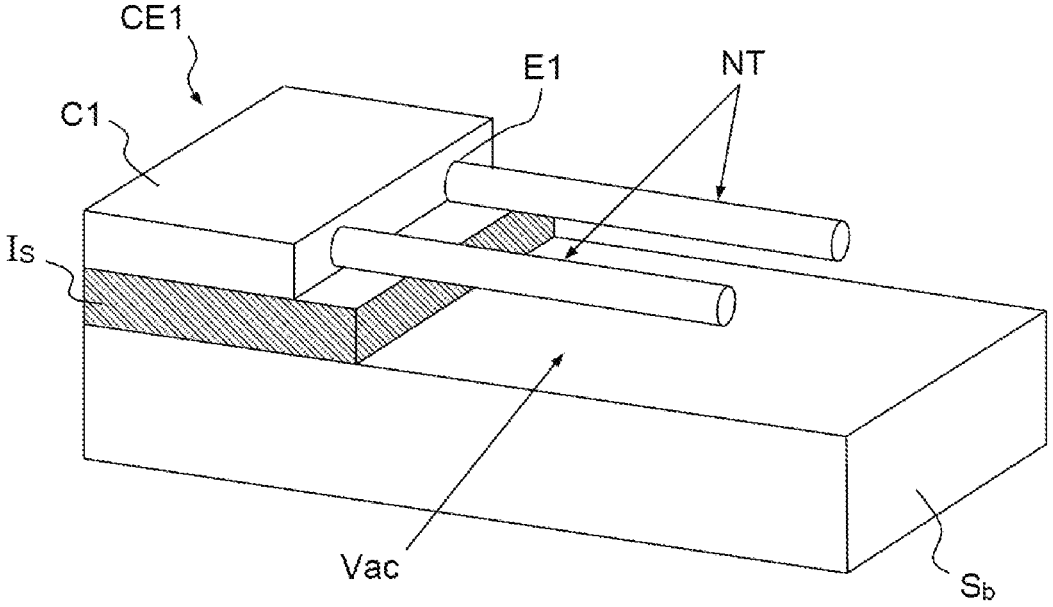
FIG. 7*b* illustrates an embodiment of the cathode according to the invention for which the insulation of the nanotubes is produced by the vacuum.

According to a preferred embodiment illustrated in FIG. 7*b*, the first connector CE1 comprises a substantially planar contact element C1 arranged an insulating layer Is and linked to a first end E1 of the element NT. The fabrication of the connector CE1 is simplified. The contact element C1 is typically metal, made of a material standard in microelectronics: aluminium, titanium, gold, tungsten, etc.).

According to an embodiment also illustrated in FIG. 7*b*, the insulation of the nanoelements NT from the substrate is performed by the vacuum.

Typically, the insulating layer Is used in the fabrication of the nanotubes has been removed (sacrificial layer) under the nanotube part, these nanotubes then being moored to the substrate by the planar contact C1, which for its part is insulated from the substrate by the insulating layer Is. Thus, in this variant, the insulation is obtained for the planar contact C1 by a physical sacrificial layer Is and for the elements NT by the vacuum Vac.

There is thus no longer any NT/insulation/vacuum interface, but only an NT/vacuum interface. The thermal insulation of the NTs is increased. Furthermore, the emission surface is increased, the bottom half-surface being able to participate in the current emitted (subject to an assurance that the external field E0 makes it possible to recover the electrons emitted by this bottom half-surface).

Figure 8:
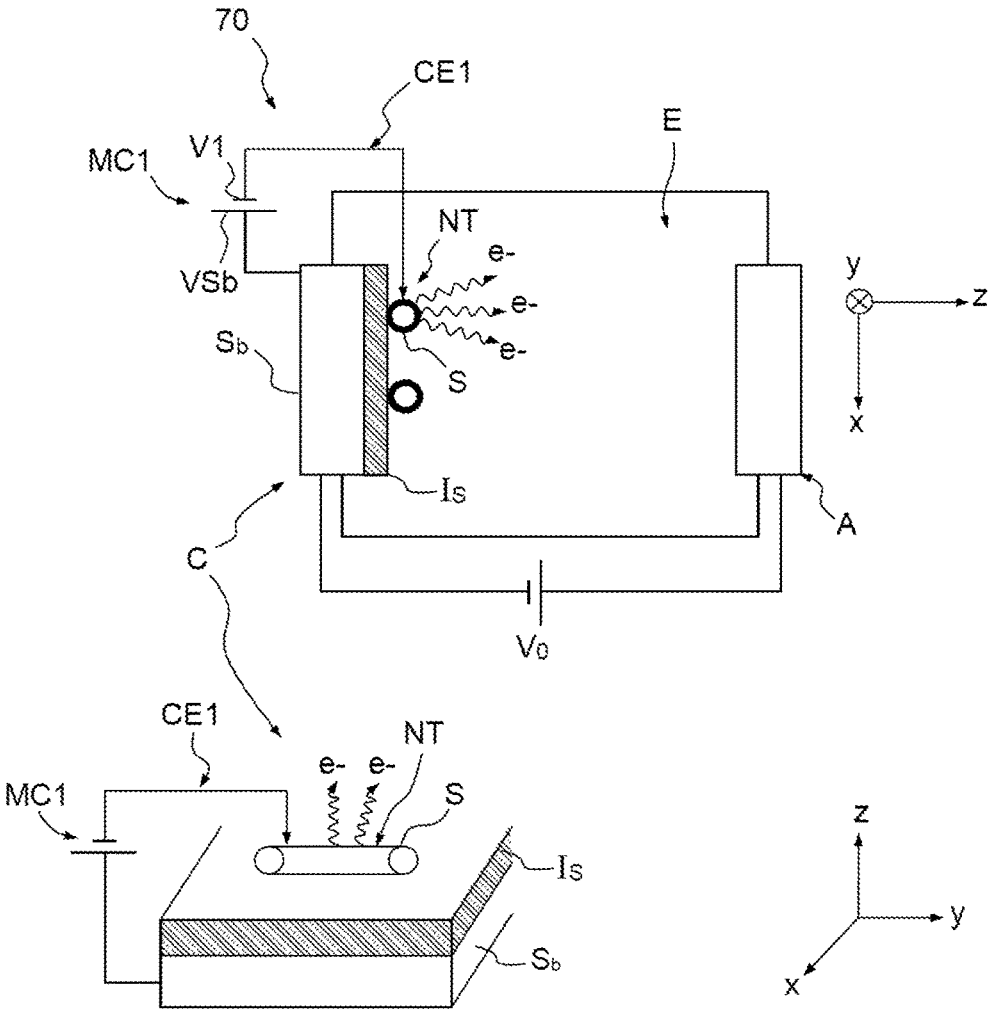
FIG. 8 illustrates a first preferred variant of a vacuum electron tube according to the invention.

According to a first preferred variant illustrated in FIG. 8, the cathode is configured to emit electrons via its surface S by tunnel effect.

For that, the cathode C of the tube 70 comprises a first control means MC1 linked to the first connector CE1, biased at the voltage V1, and to the substrate Sb, and configured to apply a bias voltage $V_{NW}$ between the substrate and the nanotube element. If $V_{Sb}$ is the potential of the substrate, then:

$$V_{NW}=V1-V_{sb}$$

To obtain field emission, it is essential for the potential difference $V_{NW}$ to be negative. The substrate can for example be linked to the ground.

The front-face contact with the elements NT via CE1 is in effect electrically insulated from the conductive substrate Sb.

For good insulation, a "thick" insulating layer Is with a thickness h of between 100 nm and 10 μm is preferable.

Figure 9:
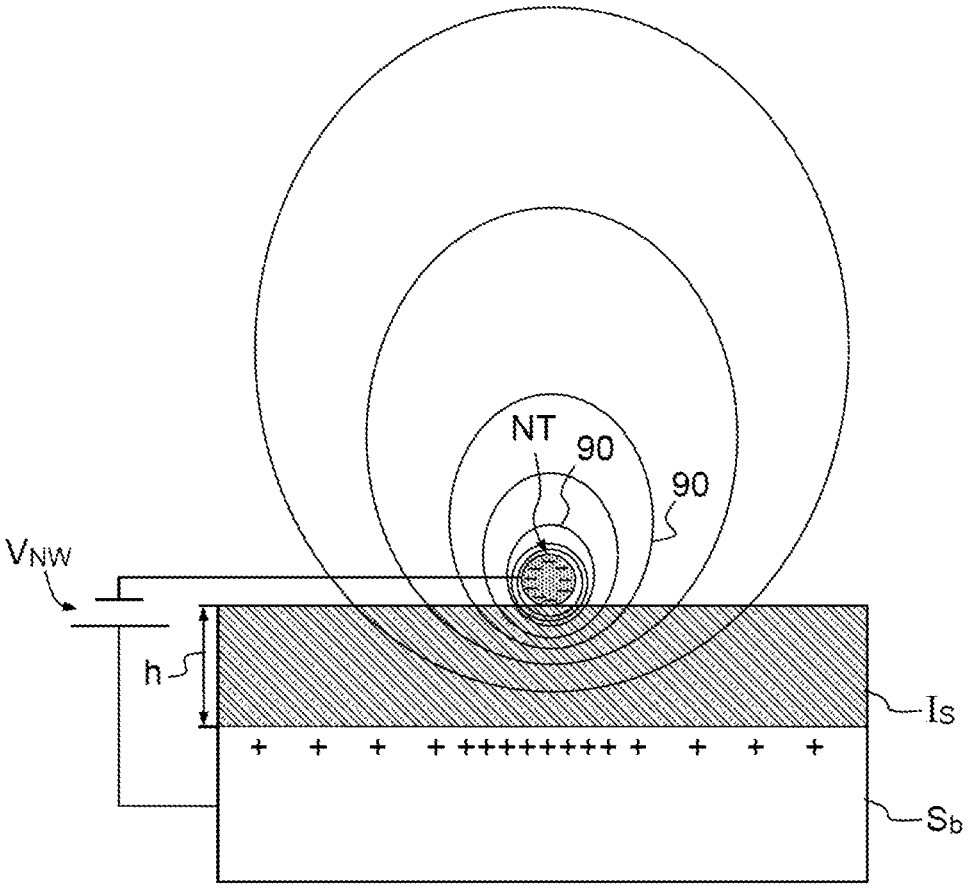
FIG. 9 schematically represents the field lines in the vicinity of a nanoelement.

The bias voltage $V_{NW}$ is therefore established between the elements NT and the substrate. This bias voltage and the external macroscopic field E0 combined induce a surface field $E_S$ on the element NT. In effect, the nanoelement/insulation/substrate system forms a capacitor which allows the generation of a large number of negative charges which are concentrated on the small surface S of the nanotube, as illustrated in FIG. 9, which generates an intense electrical field $E_S$ on the surface of the element NT, expressed by field lines 90 very close together in the vicinity of S. In the first instance the electrical field Es is inversely proportional to the radius r of the element NT.

It should be noted that the external macroscopic field applied E0 is basically necessary for the needs of the vacuum electron tube (notably to direct the electrons emitted in the tube).

Figure 10:
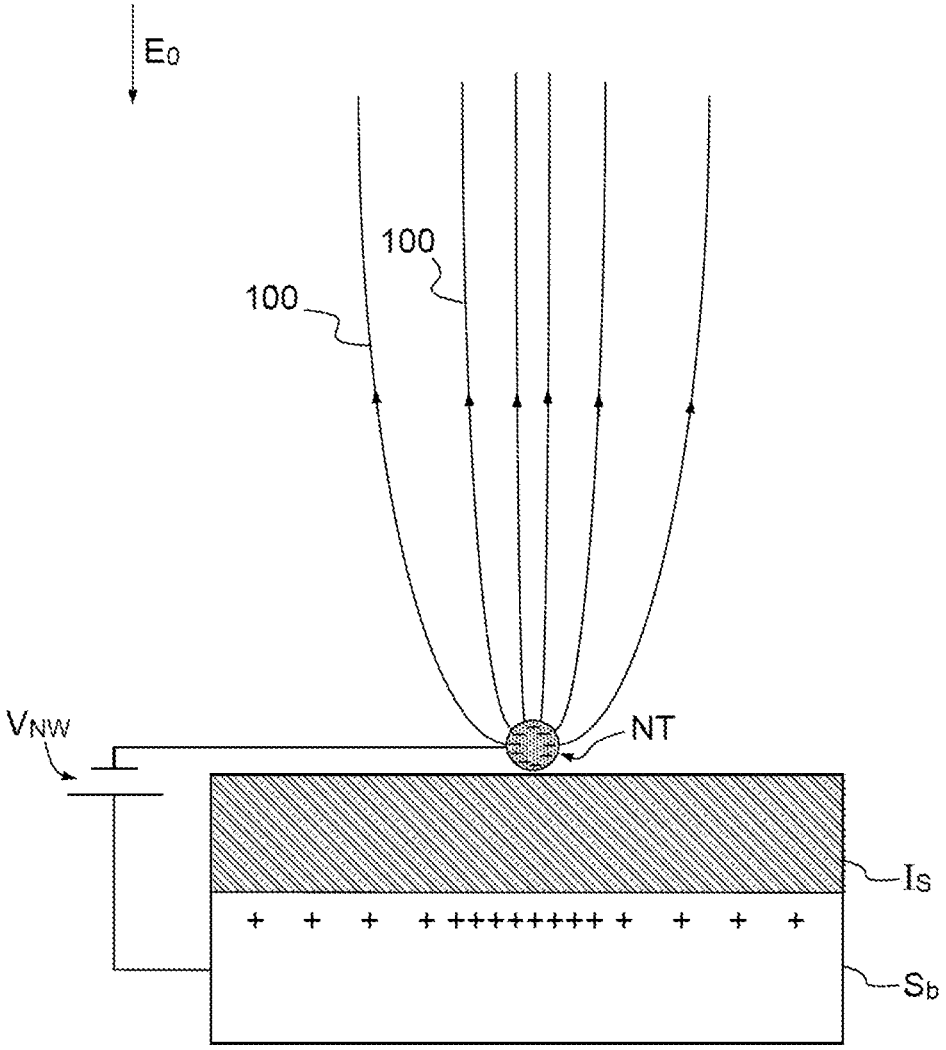
FIG. 10 schematically represents the trajectories of the electrons extracted from a nanotube in the presence of an external field.

The extraction of the electrons is performed by tunnel effect, and the electrons are emitted radially in all directions. The external field E0 makes the electrons take a trajectory 100 that is globally at right angles to the substrate, as illustrated in FIG. 10, and accelerates them. The external field E0 contributes only marginally here to the extraction (see later).

Compared to a conventional approach with emitters 1D preferentially at right angles to the substrate VACNT, there is an analogy between the height/radius of the VACNTs and the height h set by the thickness of insulation, radius of the planar nanowire/nanotube NT. Thus, compared to the emitters 1D and to the problem of dispersion of these two parameters in the fabrication explained in the state of the art section, the present invention offers the following advantages.

Regarding the height of the emitters, the horizontal emitter elements NT all have exactly the same height h, unlike in the conventional approaches (typically +/−1 μm on the vertical nanotubes, for typical heights of 5 to 10 μm), which de facto considerably reduces the issue of the dispersion of this parameter, which is solved extremely simply through the use of a homogeneous insulating layer Is produced with conventional microelectronics means.

Regarding the nanotube radius, it is possible to apply methods known furthermore to produce nanowires/nanotubes exhibiting low radius dispersions. Furthermore, the nanomaterials thus produced can be selected by various methods to reduce as much as possible the dispersion of the radius factor (a thing that is impossible if considering growth on substrate). A radius dispersion of +/−2 nm is typically achievable (compared to +/−20 nm for VACNTs).

Thus, in a cathode according to the prior art, because of the dispersion of the height and the radius of the vertical nanotubes, there are few nanotubes which effectively emit electrons, which induces a strong current per emitter, a strong current constituting a greater probability of destruction.

In the cathode C according to the invention, because of a smaller dispersion, there is less current per emitter, and therefore the cathode is more robust.

Furthermore, the cathode C is such that when the bias voltage $V_{NW}$ is low or zero, the field effect is negligible: the vacuum tube 70 operates in "Normally off" mode, which is an element of dependability sought after in certain medical X-ray tube applications.

It should also be noted that, compared to the emitters of 1D type, the tip effect of the planar nanoelements according to the invention is produced in two dimensions, and the potential electron emission surfaces are therefore significantly greater. In effect, for a 1D microtip, the surface is of the order of $\sim r^2$; whereas, for a planar nanotube it is of the order of L.r (L length of the nanowire, r radius of the nanowire) for a similar emitter density. This gain in emission surface is advantageous for targeting strong overall currents.

To obtain a tip effect and extraction by tunnel effect, preferentially the nanotube or nanowire elements NT have a radius r of between 1 nm and 100 nm.

To obtain an emission by field effect (tunnel effect) of a nanotube/nanowire element NT, the surface electrical field Es should lie between 0.5 V/nm and 5 V/nm. This range of values conditions the dimensioning of the cathode through the relationship:

With:

$$Es = \frac{h/\epsilon_r}{r \cdot a\cosh\left[\frac{h/\epsilon_r}{r}\right]}\left(E_0 - \frac{V_{NW}}{h/\epsilon_r}\right)$$

Es field at the surface of the nanotube, E0 external field applied, $V_{NW}$ bias voltage h height and εr relative permittivity of the insulating layer present under the NT r radius of the nanotube/nanowire NT The first term is purely geometrical, with typical values of 10 to 100.

The bias voltage $V_{NW}$ is typically between 100 V and 1000 V.

Typically E0 is of the order of 0.01 V/nm and the term $V_{NW}/(h/\varepsilon_r)$ is of the order of 0.1 V/nm. The term $V_{NW}/(h/\varepsilon_r)$ is large compared to E0, and it is this first term which contributes in the first instance to the obtaining of the field Es.

The fact that E0 is not used in the extraction of the electrons, that is to say that there is independence between generation/extraction (via $V_{NW}$) and acceleration (via E0) of the electrons is an enormous advantage for X-ray tubes.

According to the prior art, when the field E0 is changed, the emission current is changed.

In the cathode according to the invention, it is the bias voltage which conditions the value of the emission current, not, or very little, the external field E0. It is thus possible in an X-ray tube according to the invention to produce an image with emission currents that are identical for different energies.

Thus, typical tunnel effect fields of a few Volts/nm are obtained on the surface S of the nanowires/nanotubes NT.

Other design rules make it possible to improve the electron emission:

- Typically the distance W between two emitters NT is greater than or equal to h/2.
- Typically h/r is greater than or equal to 100: for example, h=1 to 5 μm and r=2 to 10 nm.
- Typically, the acceptable bias between top contacts and substrate is at least of the order of E0*h/εr (i.e. a few tens of volts).

Figure 11:
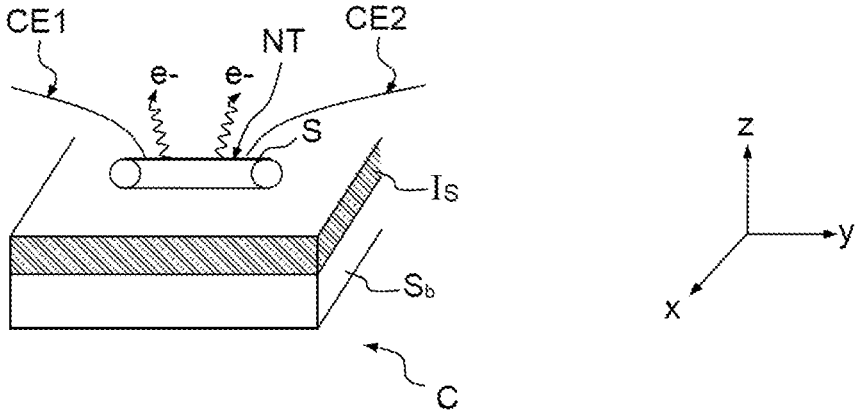
FIG. 11 illustrates a preferred variant of the cathode of the tube according to the invention in which at least one nanoelement is linked electrically to a second connector.

According to a preferred variant illustrated in FIG. 11, the cathode C comprises a second electrical connector CE2 electrically linked to at least one nanotube or nanowire element NT so as to be able to apply a second electrical potential V2 to the nanoelement. There is thus an assurance of the good connection of a greater quantity of nanotubes.

Advantageously, the cathode comprises at least one element NT linked simultaneously to the first connector CE1 and to the second connector CE2, in order to render the cathode according to the invention compatible with the use of the thermoionic effect (see later).

In this configuration, different potentials are applied to the two ends of the nanoelement, which, with a conductive substrate, is possible only with the presence of an insulation between the nanoelement and the substrate.

Preferentially, to simplify the fabrication, the cathode C comprises several nanotube or nanowire elements NT connected to the same first connector and/or to the same second connector.

Figure 12:
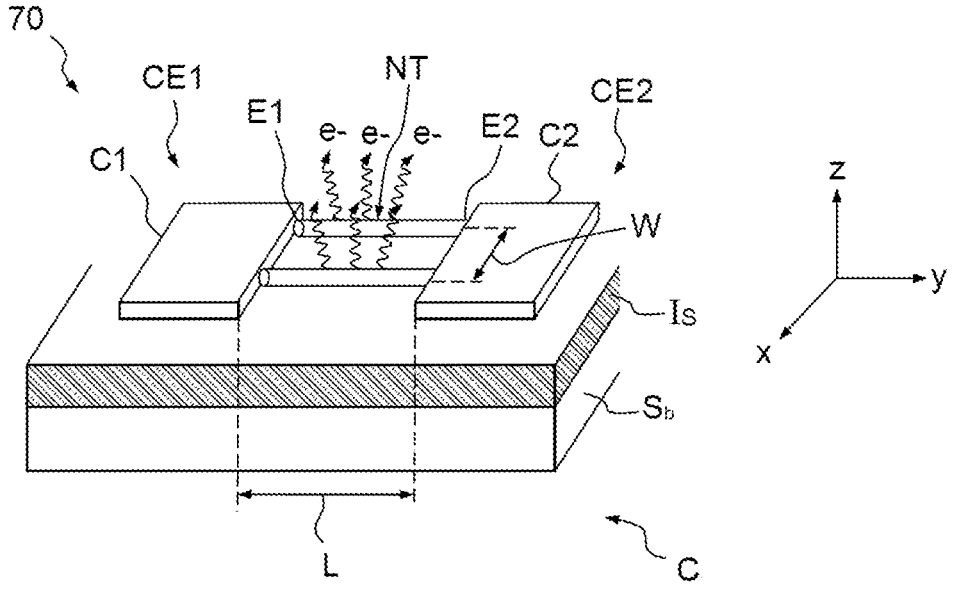
FIG. 12 illustrates a preferred variant of the cathode of the tube according to the invention in which at least one connector comprises a planar contact element arranged on the insulating layer.

Preferentially, the connector CE2 comprises a planar contact element C2 (typically metal, of a material standard in microelectronics: aluminium, titanium, gold, tungsten, etc.), arranged on an insulating layer Is and linked to a second end E2 of the element NT as illustrated in FIG. 12.

Thus, on the insulation, a series of electrical contact elements are linked to one another. The contacts are preferentially locally parallel and placed at a distance L. Between the electrodes there are the nanowires/nanotubes NT such that at least one of their ends is connected to one of the electrical contacts. The characteristic distance between two nanowires/nanotubes is denoted W.

Figure 12B:
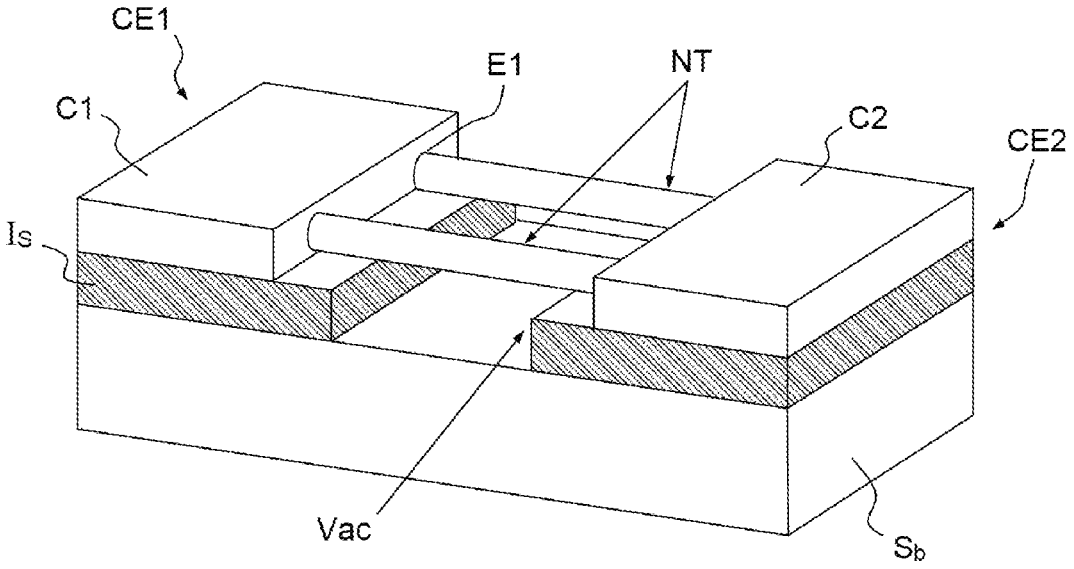
FIG. 12*b* illustrates an embodiment of the cathode of the tube according to the invention in which at least one connector comprises a planar contact element arranged on the insulating layer and the insulation of the nanotubes is produced by the vacuum.

FIG. 12 corresponds to the embodiment with a physical insulating layer Is deposited on the substrate. FIG. 12*b* illustrates the embodiment for which the layer Is has been removed under the nanotubes, also illustrated in FIG. 7*b*, the insulation of the nanotubes being produced by the vacuum present under the nanotubes NT.

Figure 13:
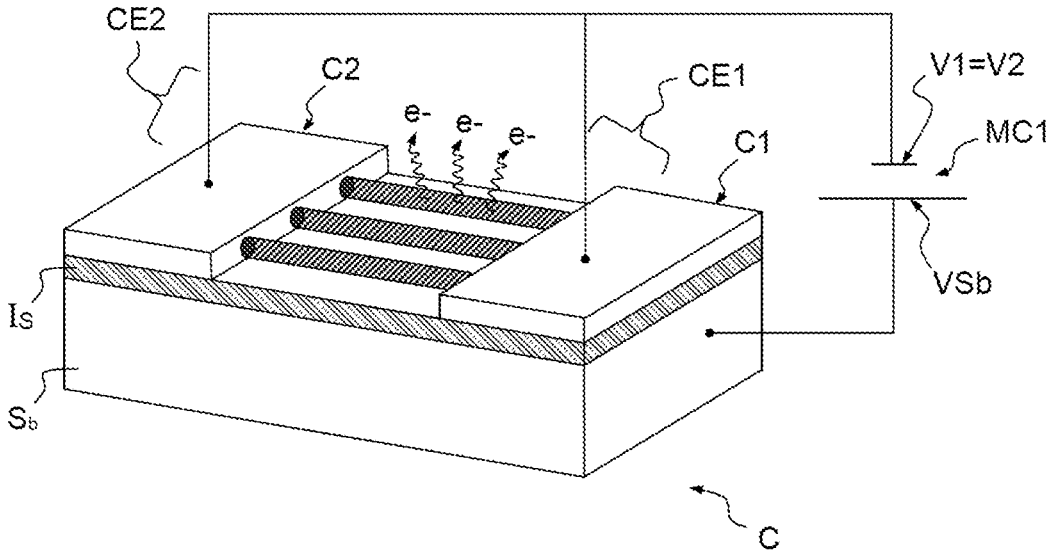
FIG. 13 illustrates a variant of the cathode of the tube according to the invention based on the tunnel effect only.

For the cathode C according to the invention having the structure of FIG. 12 or 12*b* to emit electrons by tunnel effect only, it is suitable to link together the connectors CE1 and CE2, as illustrated in FIG. 13. In this case, the potentials are equal:

$$V1=V2.$$

For a controlled emission, preferentially the distance W between the elements NT is substantially constant and controlled. In effect, it is preferable to observe an average distance of the order of the insulation thickness, the constancy in the value of the distance W being the ideal case. That makes it possible to maximize the number of effective emitters per unit of surface area and therefore increase the associated emission current. The emitters are called upon in the same way which maximizes the associated emission current and increases the lifetime/robustness of the cathode.

With such a geometry, densities of 50 000 to 100 000 per $mm^2$ are obtained ("fill factor" less than 1 due to the integration of the contact relays on the front face). Each element NT has an emissive surface of the order of 7000 $nm^2$ (useful emission of the half-surface S).

The nominal emission currents per emitter (of the order of 200 nA) are acceptable by the nanowires/nanotubes.

According to another variant, the cathode C according to the invention emits electrons by thermoionic effect, by heating the element NT. Thus, the cathode C further comprises means for heating the nanotube or nanowire element NT. For that, it is not necessary to specifically dimension the elements NT, there is no constraint on the height h of the insulating layer Is or on the radius r of the elements NT. It is suitable in this case to use a material with low work function for the nanoelements, such as tungsten or molybdenum.

A preferred means for heating the nanotube/nanowire is to pass a current into the latter. For that, at least one nanotube or nanowire element NT must be linked simultaneously to the first connector CE1 and to the second connector CE2.

Figure 14:
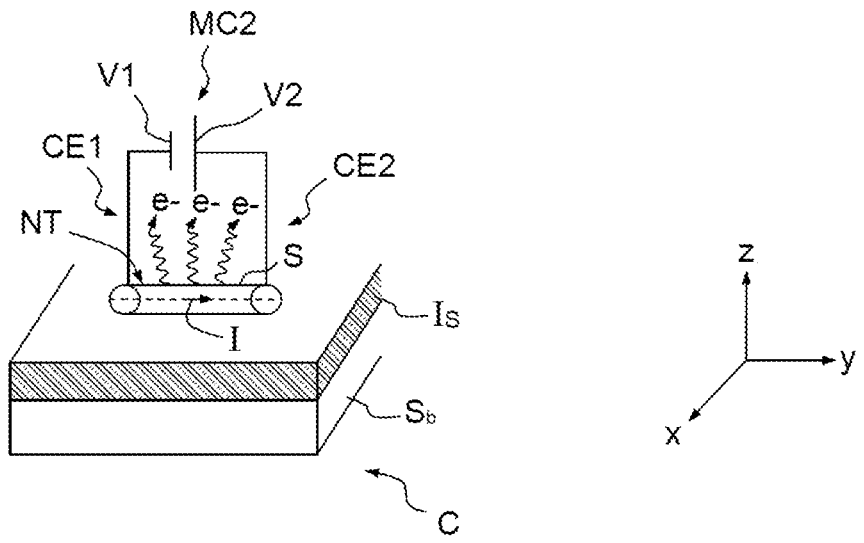
FIG. 14 illustrates a variant of the cathode of the tube according to the invention in which at least one nanoelement already linked to a first connector is also linked to a second connector separated spatially from the first connector.

According to an embodiment in FIG. 14, the heating means comprise a second control means MC2 configured to apply a heating voltage Vch to the nanotube or nanowire element NT via the first electrical potential V1 and the second electrical potential V2.

The following applies: Vch=V1−V2

An electric current I is thus generated in the nanotube/nanowire element NT.

The two connectors CE1 and CE2 must be separated spatially sufficiently on the nanotube to allow the current to circulate.

For a variant of the invention in which only the thermoionic effect is used (no bias voltage $V_{NW}$ or specific dimensioning), it is suitable to heat the element NT to a heating temperature greater than or equal to 1000° Celsius.

When the thermoionic effect combines with/complements the tunnel effect (see later), a heating temperature greater than 600° Celsius is sufficient.

Preferentially, the heating voltage Vch lies between 0.1 V and 10 V.

Thus, a cathode configured according to the invention comprises at least one control means (MC1 and/or MC2) linked to the first connector CE1 and configured to apply a potential difference such that the cathode emits electrons from its surface S. The potential difference being applied:

first control means MC1: between the element NT (V1 via CE1) and the substrate Sb (potential of the substrate VSb) for an electron emission by tunnel effect (bias voltage $V_{Nw}$=V1−VSb), second control means MC2: to the element NT itself (V1 via CE1 and V2 via CE2) for an emission by thermoionic effect (heating voltage Vch=V1−V2).

The bias voltage and the heating voltage being able to be applied simultaneously to benefit from the two effects.

Figure 15:
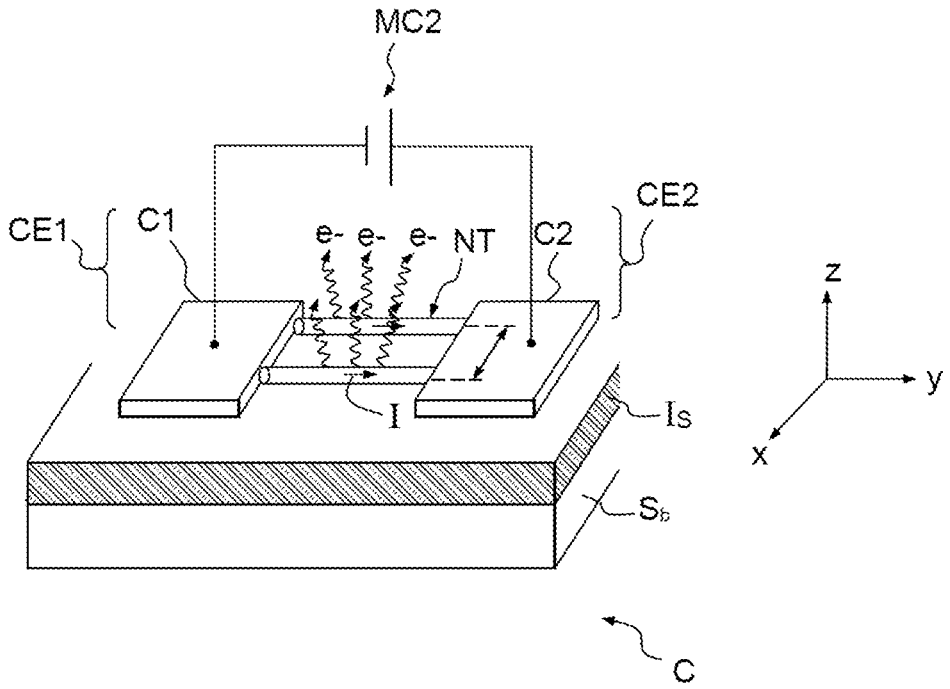
FIG. 15 illustrates a variant of the cathode of the tube according to the invention based on the thermoionic effect.

FIG. 15 illustrates a cathode C according to the invention configured to emit electrons by thermoionic effect and based on planar contacts C1 and C2 of the same nature as those described in FIGS. 12 and 12*b*. The electrical voltage applied via CE1 and CE2 (respectively by the relay of contacts C1 and C2) creates a current I in the nanotube/nanowire element NT. In this case, the current I circulates from one end to the other of the nanotube NT.

Figure 16:
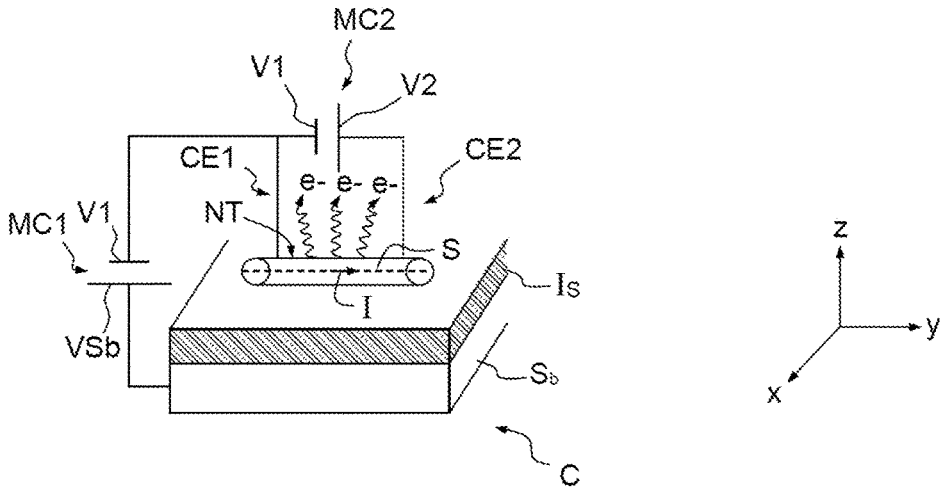
FIG. 16 illustrates a variant of the cathode of the tube according to the invention using both the tunnel effect and the thermoionic effect.
Figure 17:
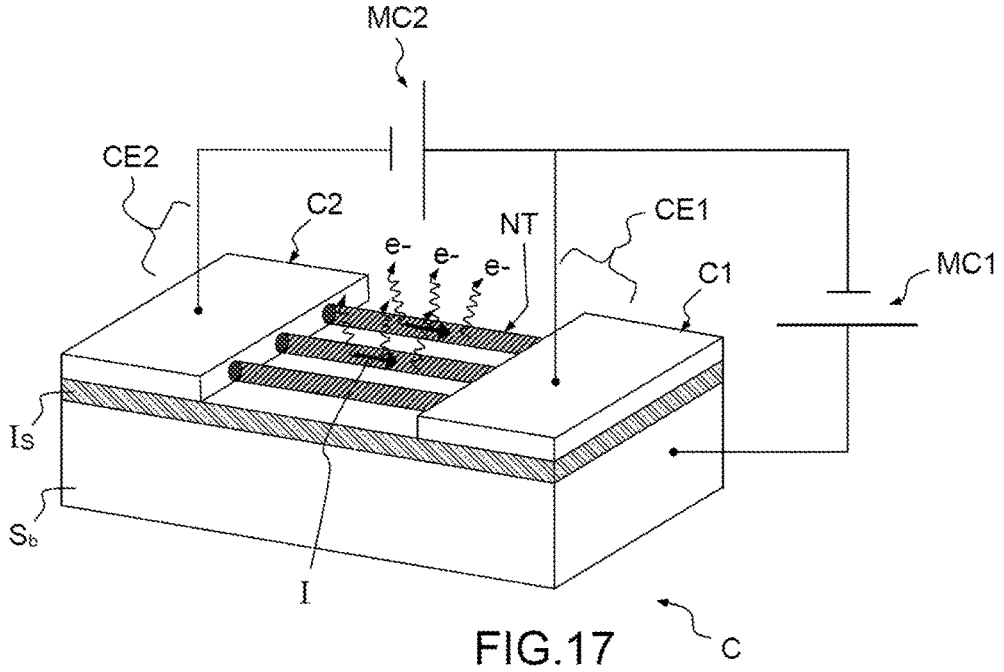
FIG. 17 illustrates a variant of the cathode of the tube according to the invention comprising planar contacts and using both the tunnel effect and the thermoionic effect.

According to one embodiment, the cathode according to the invention combines the two physical electron emission effects, tunnel effect and thermoionic effect, as illustrated according to the principle in FIG. 16. For that, a bias voltage $V_{NW}$ (between 100 V and 1000 V) between substrate and nanoelement and a voltage Vch (between 0.1 V and 10 V) between two parts of the nanoelement NT are applied simultaneously. The nanotube NT preferentially has a radius r of between 1 nm and 100 nm, to optimize the tunnel effect. FIG. 17 illustrates the combination of the two effects by using two planar contacts C1 and C2. A greater electron emission is thus obtained than when the two physical effects are used in isolation. In effect, the structure being used in a vacuum, heating the emissive element makes it possible to reduce the field to be applied to emit a given current which is useful for reducing the dimensions for example of the insulation. Furthermore, since the emissive elements are "hot", problems of surface contamination are avoided (the elements are less easily adsorbed on the hot surfaces). This improves the stability of the emission.

Figure 18:
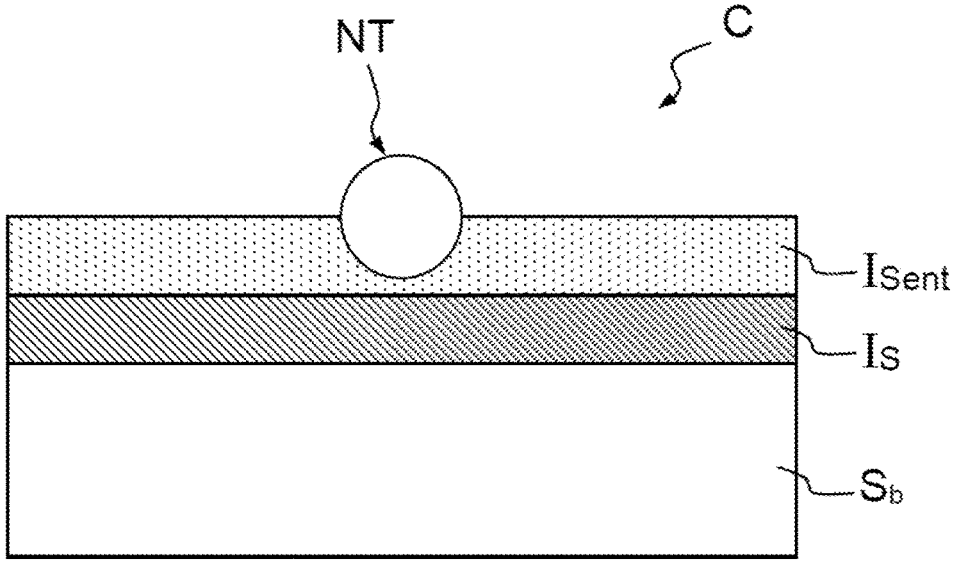
FIG. 18 illustrates an embodiment of nanoelement in which these nanoelements are partially buried in an insulating layer.

The presence of a vacuum—insulation—nanowire/nanotube interface is likely to induce a local exacerbation of the field. Since this interface is located "under" the nanowire, it is preferable to reduce this effect because it can lead to a local electron injection in the insulation and undesirable charge effects. For that, according to an embodiment illustrated in FIG. 18, the nanotube or nanowire elements NT are partially buried in a burying insulating layer Isent. A constant field level according to the perimeter of the nanowire/nanotube is thus obtained.

According to a variant, the layer Isent is the insulating layer arranged on the substrate Sb.

According to a preferred variant, the layer Isent consists of at least one additional layer deposited on the insulating layer Is. In effect, this partial burying can provoke an electron emission in the insulation, which induces local charge effects, these effects "screening" the action of the substrate. Preferentially, local encapsulation in a material exhibiting a strong dielectric permittivity (called "high-k" material), such as $HfO_2$, with $\varepsilon_{HfO2}$=24, is performed to act on the permittivity effect and thus minimize the field of the nanowire at the junction with the insulation while maximizing the field on the free part of the nanowire. According to an embodiment, the burying layer Isent is a multilayer made up of a plurality of sublayers. The structure of the field lines is thus better controlled and the undesirable exacerbation effects are limited. Furthermore, it is possible to act on the permittivity/dielectric strength parameters of the different layers to optimize the applicable voltages in the structure.

Advantageously, approximately half of the nanoelement is buried in the layer Isent.

However, the incorporation of a material with strong permittivity, even in a thin layer, can significantly modify the effective height, and this aspect should be taken into account in the dimensioning of the thickness h of the layer Is.

Figure 19:
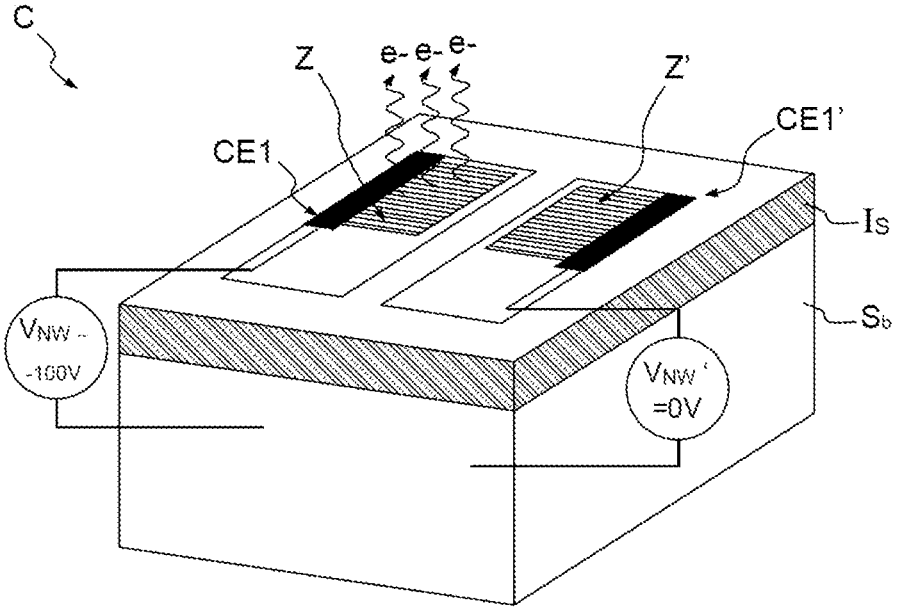
FIG. 19 schematically represents an example of the use of a cathode according to the invention divided into zones.
Figure 20:
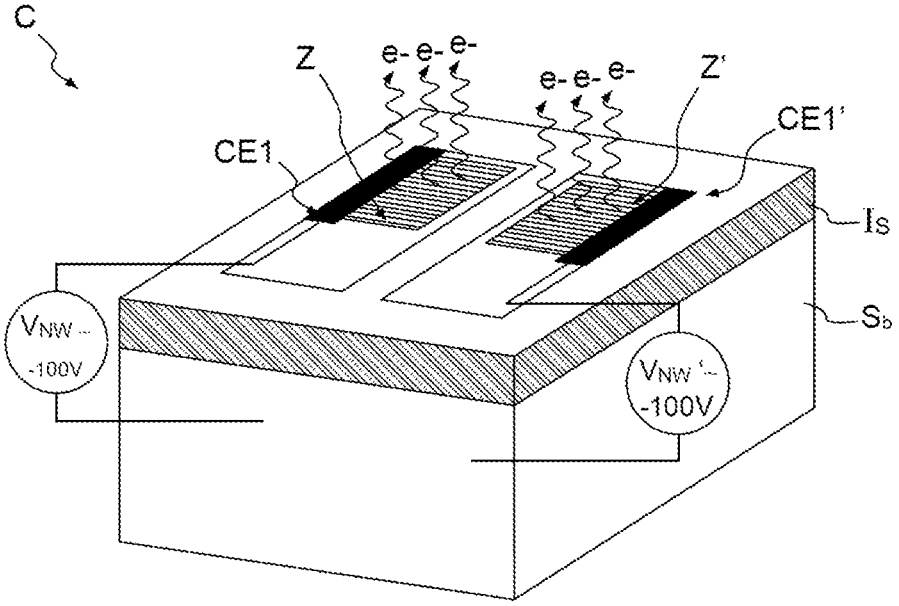
FIG. 20 schematically represents another example of the use of a cathode according to the invention divided into zones.

According to another variant illustrated in FIGS. 19 and 20, the cathode C is divided into a plurality of zones Z, Z', each zone comprising nanotube or nanowire elements linked to one and the same first electrical connector: for example the elements NT of the zone Z are linked to CE1 and the elements NT of the zone Z' are linked to CE1', CE1 being different from CE1'. It is then possible to apply bias voltages $V_{NW}$ and $V_{NW}'$ to each zone that are independent of one another and reconfigurable. The emission is thus "pixelated" by producing several electrically autonomous emission zones in order to spatially modulate the emission zone. FIG. 19 illustrates a cathode C comprising an emitting zone Z whereas a zone Z' does not emit, and FIG. 20 illustrates a cathode C with both zones Z and Z' emitting.

According to the prior art, the spatial modulation of the emission zone is produced by juxtaposing several cathodes alongside one another.

An advantage of the pixelation of a cathode is that it is possible, for imaging applications, initially to identify a zone of interest by illuminating using a wide emission zone, then, once the zone of interest has been detected, peform an illumination of the zone of interest with an emission zone of smaller dimensions allowing increased resolution.

Figure 21:
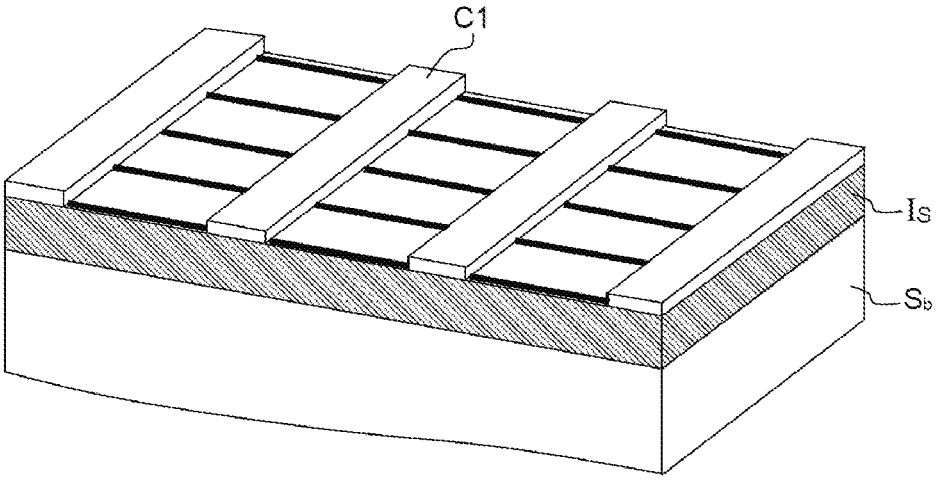
FIG. 21 illustrates a cathode variant according to the invention in which at least one planar contact is common to two groups of nanoelements.

According to a variant illustrated in FIG. 21, at least one planar contact C1 is common to two groups of nanoelements. The network of nanoelements is thus made denser.

Preferentially, the nanotubes/nanoelements NT are made of conductive material, such as carbon, doped ZnO, doped silicon, silver, copper, tungsten, etc.

According to another embodiment, the nanotube/nanowire elements are semiconductors, for example made of Si, SiGe or GaN, so as to induce the presence by field effect and/or by illumination, which makes it possible to have increased control of the electron emission.

The nanowire or nanotube element then constitutes a channel of a capacitor of MOS type. The generation of carriers works when the bias voltage $V_{NW}$ is greater than a threshold voltage Vth.

In the case of a photogeneration of the carriers, the tube 70 further comprises a light source configured to illuminate the nanotube or nanowire element; the free carriers are then generated by photogeneration.

Semiconductor nanoelements NT can be used to generate electrons by tunnel effect and/or by thermoionic effect.

Figure 22A:
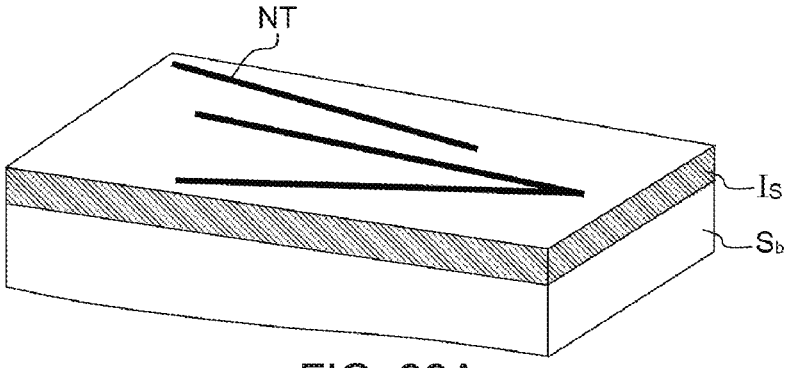
FIGS. 22*a* and 22*b* illustrate a first method for fabricating nanotubes/nanowires.
Figure 22B:
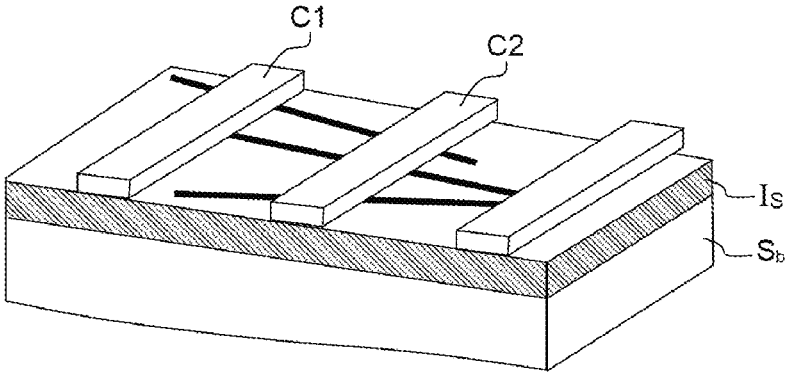

By way of illustration, FIGS. 22*a* and 22*b* show a first method for fabricating the cathode C according to the invention, of "bottom up" type. In a first step illustrated in FIGS. 22*a* and 22*b*, a dispersion of nanowires/nanotubes NT has been produced on an insulating layer Is deposited on a conductive substrate Sb ("spray", "dip coating", electrophoresis). The key point is having an average distance W between nanowires/nanotubes that can be controlled.

In a second step illustrated in FIG. 22*b*, the contacts are produced by lift-off on the mat previously produced. It should be noted that the contacts can be produced before the dispersion (preferably buried contacts for the surface of the contact material to be level with the surface of the insulation) to have only the dispersion to be produced as final production step.

Figure 23A:
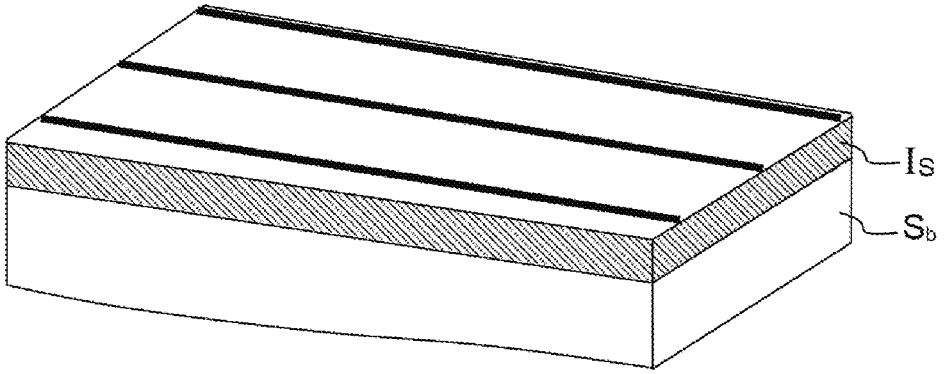
FIGS. 23*a* and 23*b* illustrate a second method for fabricating nanotubes/nanowires.
Figure 23B:
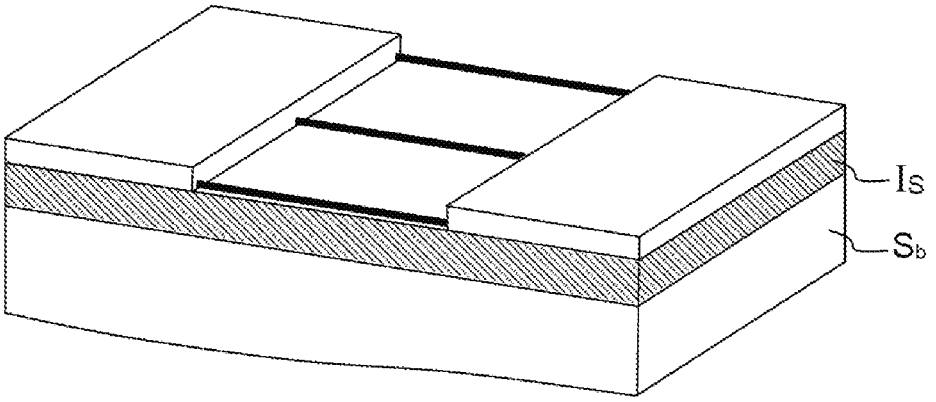

FIGS. 23*a* and 23*b* show second method for fabricating the cathode C according to the invention, of "top-down" type. A thin layer (intended to be the emitter material) is deposited on an insulating layer Is, itself on a conductive substrate Sb. An etch mask is produced on this layer and the material is etched to leave only the nanowires/nanotubes on the substrate+insulation, as illustrated in FIG. 23*a*.

Then, the contacts are produced by lift-off on the mat previously produced, as illustrated in FIG. 23*b*. It should be noted that, as previously, the contacts can be produced before the dispersion (preferably buried contacts for the surface of the contact material to be level with the surface of the insulation) to have only the dispersion to be produced as final production step.

The invention claimed is:

1. A vacuum electron tube comprising at least one electron-emitting cathode and at least one anode arranged in a vacuum chamber, the cathode having a planar structure comprising a substrate made of a conductive material, a plurality of nanotube or nanowire elements electrically insulated from the substrate, the longitudinal axis of said nanotube or nanowire elements being substantially parallel to the plane of the substrate, and at least one first connector electrically linked to at least one nanotube or nanowire element so as to be able to apply a first electrical potential to the nanowire or nanotube element.

2. The vacuum electron tube according to claim 1, wherein the nanotube or nanowire elements are substantially parallel to one another.

3. The vacuum electron tube according to claim 1, wherein which the first connector comprises a substantially planar contact element arranged on an insulating layer and linked to a first end of said nanotube or nanowire element.

4. The vacuum electron tube according to claim 1, wherein the cathode further comprises a first control means linked to the first connector and to the substrate, and configured to apply a bias voltage between the substrate and the nanotube element so that the nanotube or nanowire element emits electrons through its surface by tunnel effect.

5. The vacuum electron tube according to claim 4, wherein the bias voltage lies between 100 V and 1000 V.

6. The vacuum electron tube according to claim 1, wherein the nanotube or nanowire elements have a radius of between 1 nm and 100 nm.

7. The vacuum electron tube according to claim 1, wherein the cathode comprises a second electrical connector linked electrically to at least one nanotube or nanowire element so as to be able to apply a second electrical potential to the nanotube or nanowire element.

8. The vacuum electron tube according to claim 7, wherein the first and the second connectors respectively comprise a first and a second substantially planar contact elements arranged on an insulating layer and respectively linked to a first and a second ends of said nanotube or nanowire element.

9. The vacuum electron tube according to claim 7, wherein the cathode comprises at least one nanotube or nanowire element linked simultaneously to the first connector and to the second connector.

10. The vacuum electron tube according to claim 1, wherein the cathode further comprises means for heating the nanotube or nanowire element.

11. The vacuum electron tube according to claim 9, wherein the cathode comprises a second control means linked to the first and to the second connectors and configured to apply a heating voltage to said nanotube or nanowire element via the first and the second electrical potentials, so as to generate an electric current in said nanotube or nanowire element, such that the nanotube or nanowire element emits electrons through its surface by thermoionic effect.

12. The vacuum electron tube according to claim 11, wherein the heating voltage lies between 0.1 V and 10 V.

13. The vacuum electron tube according to claim 1, wherein the nanotube or nanowire elements are partially buried in a burying insulating layer.

14. The vacuum electron tube according to claim 4, wherein the cathode is divided into a plurality of zones, the nanotube or nanowire elements of each zone being linked to a different first electrical connector, such that the bias voltages applied to each zone are independent and reconfigurable.

15. The tube according to claim 1, wherein the nanotube or nanowire elements are conductors.

16. The vacuum electron tube according to claim 4, wherein the nanotube or nanowire elements are semiconductors and wherein the bias voltage is greater than a threshold voltage, the nanowire or nanotube element then constituting a channel of a capacitor of MOS type, so as to generate free carriers in the nanowire or nanotube element.

17. The vacuum electron tube according to claim 16, wherein the cathode further comprises a light source configured to illuminate the nanotube or nanowire element so as to generate free carriers in said nanowire or nanotube element by photogeneration.

* * * * *